US006756726B2

(12) United States Patent
Ogawa et al.

(10) Patent No.: US 6,756,726 B2
(45) Date of Patent: Jun. 29, 2004

(54) DEFLECTION YOKE AND CATHODE-RAY TUBE APPARATUS WITH THE SAME

(75) Inventors: Masaru Ogawa, Fukaya (JP); Sadami Sekiguchi, Yokohama (JP); Tadahiro Kojima, Kumagaya (JP); Takashi Murai, Fukaya (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 0 days.

(21) Appl. No.: 10/465,875

(22) Filed: Jun. 20, 2003

(65) Prior Publication Data

US 2003/0222566 A1 Dec. 4, 2003

Related U.S. Application Data

(63) Continuation of application No. PCT/JP02/11212, filed on Oct. 29, 2002.

(30) Foreign Application Priority Data

Oct. 30, 2001 (JP) ..... 2001-333188
Oct. 30, 2001 (JP) ..... 2001-333189
Oct. 25, 2002 (JP) ..... 2002-311454

(51) Int. Cl.[7] ..... H01J 29/70
(52) U.S. Cl. ..... 313/440; 313/441; 313/477 R
(58) Field of Search ..... 313/440, 441, 313/442, 477 R, 413

(56) References Cited

U.S. PATENT DOCUMENTS 5,801,481 A * 9/1998 Yokota ..... 313/440
5,962,964 A * 10/1999 Sano et al. ..... 313/440
6,166,484 A 12/2000 Okuyama et al.
2002/0008458 A1 1/2002 Akoh et al.

FOREIGN PATENT DOCUMENTS

| | | |
|---|---|---|
| EP | 0 425 747 A1 | 5/1991 |
| JP | 10-188849 | 7/1998 |
| JP | 10-265668 | 9/1999 |
| JP | 11-265666 | 9/1999 |

* cited by examiner

*Primary Examiner*—Vip Patel
*Assistant Examiner*—Kevin Quarterman
(74) *Attorney, Agent, or Firm*—Pillsbury Winthrop LLP

(57) ABSTRACT

In a semi-toroidal deflection yoke, a middle point CL(M) of an entire length along a tube axis from a large-diameter portion to a small-diameter portion of a magnetic core lies on a small-diameter portion side of a horizontal deflection coil relative to a point lying at a distance of 0.41×HL along the tube axis from a large-diameter portion of the horizontal deflection coil, where HL is an entire length of the horizontal deflection coil along the tube axis. The deflection yoke deflects electron beams efficiently, reducing the deflection electric power the deflection yoke requires. A cathode ray tube provided with the deflection yoke can suppress pin-cushion type distortion which may occur in the vertical direction of a screen, and can therefore display images of satisfactory quality.

12 Claims, 9 Drawing Sheets

| HL / VL (≒HL / CL) | Less than 1.8 | 1.8 ~ 2.4 | Greater than 2.4 |
|---|---|---|---|
| Sensitivity | △ | ○ | ◎ |
| Non-light-emission area at diagonal corner of screen | ◎ | ○ | × |

FIG. 15

| HHL / VL (≒HHL / CL) | Less than 1.2 | 1.2 ~ 1.8 | Greater than 1.8 |
|---|---|---|---|
| Sensitivity | △ | ○ | ◎ |
| Non-light-emission area at diagonal corner of screen | ◎ | ○ | × |

FIG. 16

DEFLECTION YOKE AND CATHODE-RAY TUBE APPARATUS WITH THE SAME

CROSS-REFERENCE TO RELATED APPLICATIONS

This is a Continuation Application of PCT Application No. PCT/JP02/11212, filed Oct. 29, 2002, which was not published under PCT Article 21(2) in English.

This application is based upon and claims the benefit of priority from the prior Japanese Patent Applications No. 2001-333188, filed Oct. 30, 2001; No. 2001-333189, filed Oct. 30, 2001; and No. 2002-311454, filed Oct. 25, 2002, the entire contents of all of which are incorporated herein by reference.

BACKGROUND OF THE INVENTION

1. Field of the Invention

The present invention relates to a deflection yoke and a cathode-ray tube apparatus with the deflection yoke. In particular, this invention relates to a semitoroidal deflection yoke comprising a pair of saddle-shaped horizontal deflection coils with a substantially truncated-pyramidal shape; a magnetic core with a substantially truncated-conical shape; and a pair of vertical deflection coils with a toroidal shape, and also to a cathode-ray tube apparatus having this semitoroidal deflection yoke.

2. Description of the Related Art

At present, self-convergence type inline color cathode-ray tube apparatuses have widely been used. This type of cathode-ray tube apparatus includes an inline electron gun assembly that emits three inline electron beams traveling in a single plane, and a deflection yoke that produces a pincushion-shaped horizontal deflection magnetic field and a barrel-shaped vertical deflection magnetic field.

In this cathode-ray tube apparatus, the deflection yoke is a component that principally consumes electric power. In order to reduce the power consumption of the cathode-ray tube apparatus, it is necessary to reduce the power consumption of the deflection yoke. Besides, in these years, enhanced resolution and visibility have been required, and a high deflection frequency has been used in most cases. For example, in order to use this cathode-ray tube apparatus for a high-definition TV or a monitor of an OA apparatus such as a personal computer, the deflection frequency needs to be increased. However, when the deflection yoke is activated by such a high frequency, the deflection electric power increases and also the amount of heat emitted from the deflection yoke increases.

In general, the deflection electric power is reduced by decreasing the diameter of the neck of the envelope and the outside diameter of the yoke mount section, thereby making smaller the space for actions of the deflection magnetic fields and causing the deflection magnetic fields to efficiently act on electron beams. However, in the conventional cathode-ray tube apparatus, the electron beams travel in the vicinity of the inner surface of the yoke mount section. Thus, if the diameter of the neck or the outside diameter of the yoke mount section is further reduced, the electron beams may impinge on the inner surface of the yoke mount section before reaching the phosphor screen. For example, when the deflection angle of electron beams takes a maximum value, that is, when the electron beams are deflected toward a corner of the phosphor screen, the electron beams impinge on the inner surface of the yoke mount section and an area on which no electron beams arrive will occur on the phosphor screen. Furthermore, if the electron beams continue to impinge on the inner surface of the yoke mount section, the temperature of the inner surface rises and there is a possibility of implosion of the vacuum envelope. In the conventional cathode-ray tube apparatus, it is thus difficult to further reduce the diameter of the neck or the outside diameter of the yoke mount section, thereby decreasing the deflection electric power.

As a solution to this problem, there is a proposal to form the yoke mount section in such a shape as to vary gradually from a circular shape on the neck side to a substantially rectangular shape on the panel side. This solution is based on the idea that when a rectangular raster is described on the phosphor screen, the region of passage of electron beams within the yoke mount section also becomes substantially rectangular.

If the yoke mount section is formed in a substantially truncated-pyramidal shape, according to the above proposal, it is possible to reduce the diameters of the yoke mount section in the major axis (horizontal axis) direction and minor axis (vertical axis) direction, while preventing the electron beams deflected toward the corner of the phosphor screen from impinging on the inner surface of the yoke mount section. Thus, by forming the horizontal deflection coils, vertical deflection coils and magnetic core in truncated-pyramidal shapes, the horizontal deflection coils and vertical deflection coils are disposed closer to the region where the electron beams travel. Accordingly, the electron beams can efficiently be deflected and the deflection electric power can be reduced.

On the other hand, there are various types of deflection yokes. For instance, there are a saddle/saddle type deflection yoke having saddle-shaped horizontal and vertical deflection coils, and a semitoroidal deflection yoke having a combination of a saddle-shaped horizontal deflection coil and a toroidal vertical deflection coil.

The saddle/saddle type deflection yoke comprises a pair of truncated-pyramidal saddle-shaped horizontal deflection coils disposed on the inside of a separator; a pair of truncated-pyramidal saddle-shaped vertical deflection coils disposed on the outside of the separator; and a truncated-pyramidal magnetic core covering the vertical deflection coils (see, for instance, Jpn. Pat. Appln. KOKAI Publication No. 11-265666).

In the above-described saddle/saddle type deflection coils, compared to the semitoroidal deflection coils, the deflection electric power can be reduced. However, it is difficult to manufacture the truncated-pyramidal magnetic core with high precision. It is also difficult to wind the vertical deflection coils around the truncated-pyramidal magnetic core in a toroidal fashion. Consequently, the manufacturing cost of the deflection yoke increases, and a general-purpose use is difficult to achieve.

Furthermore, the saddle/saddle type deflection coils have a small space for radiation of heat emitted from the horizontal deflection coils and vertical deflection coils, and the temperature of the deflection yoke may rise. In these years, in accordance with the modern trend toward flattening of the outer surface shape of the panel, the inner surface shape of the panel has also become flattened more and more. To meet the trend, if design is made to correct a pincushion type distortion in the vertical direction of the screen and to make it substantially linear at the peripheral areas, the vertical pincushion type distortion near an intermediate area in the vertical direction may remain in some cases. This may degrade the quality of display images.

BRIEF SUMMARY OF THE INVENTION

The present invention has been made in consideration of the above problems, and its object is to provide a deflection yoke with reduced deflection electric power, manufacturing cost and heat emission amount, and with an enhanced quality of a display image on the screen, and to also provide a cathode-ray tube apparatus having this deflection yoke.

According to a first aspect of the invention, there is provided a deflection yoke comprising:

a pair of saddle-shaped horizontal deflection coils disposed to be symmetric with respect to a center axis and having a substantially truncated-pyramidal shape;

a magnetic core having a substantially truncated-conical shape and disposed coaxially with the center axis on an outer peripheral side of the horizontal deflection coils; and a pair of toroidal vertical deflection coils disposed to be symmetric with respect to the center axis, wherein a middle point of an entire length along the center axis from a large-diameter portion to a small-diameter portion of the magnetic core lies on a small-diameter portion side of the horizontal deflection coil relative to a point lying at a distance of 0.41×HL along the center axis from a large-diameter portion of the horizontal deflection coil, where HL is an entire length of the horizontal deflection coil along the center axis.

According to a second aspect of the invention, there is provided a cathode-ray tube apparatus comprising: a vacuum envelope having a panel with a phosphor screen disposed on an inside of the panel, a funnel formed continuous with the panel, and a cylindrical neck formed continuous with a small-diameter end portion of the funnel;

an electron gun assembly disposed within the neck and emitting electron beams toward the phosphor screen; and a deflection yoke mounted on an outside of the vacuum envelope and producing deflection magnetic fields for deflecting the electron beams emitted from the electron gun assembly in horizontal and vertical directions, wherein the deflection yoke comprises:

a pair of saddle-shaped horizontal deflection coils disposed to be symmetric with respect to a tube axis and having a substantially truncated-pyramidal shape;

a magnetic core having a substantially truncated-conical shape and disposed coaxially with the tube axis on an outer peripheral side of the horizontal deflection coils; and a pair of toroidal vertical deflection coils disposed to be symmetric with respect to the tube axis, wherein a middle point of an entire length along the tube axis from a large-diameter portion to a small-diameter portion of the magnetic core lies on a small-diameter portion side of the horizontal deflection coil relative to a point lying at a distance of 0.41×HL along the tube axis from a large-diameter portion of the horizontal deflection coil, where HL is an entire length of the horizontal deflection coil along the tube axis.

BRIEF DESCRIPTION OF THE SEVERAL VIEWS OF THE DRAWING

FIG. 15 is a table showing the relationship between the ratio of the whole length of the horizontal deflection coil to the whole length of the vertical deflection coil (magnetic core), on the one hand, and the deflection sensitivity and the presence/absence of a non-light-emission area on a diagonal corner portion of the screen, on the other; and FIG. 16 is a table showing the relationship between the ratio of the whole length of the opening portion of the horizontal deflection coil to the whole length of the vertical deflection coil (magnetic core), on the one hand, and the deflection sensitivity and the presence/absence of a non-light-emission area on a diagonal corner portion of the screen, on the other.

DETAILED DESCRIPTION OF THE INVENTION

A deflection yoke and a cathode-ray tube apparatus with the deflection yoke, according to embodiments of the present invention, will now be described with reference to the accompanying drawings.

Figure 1:
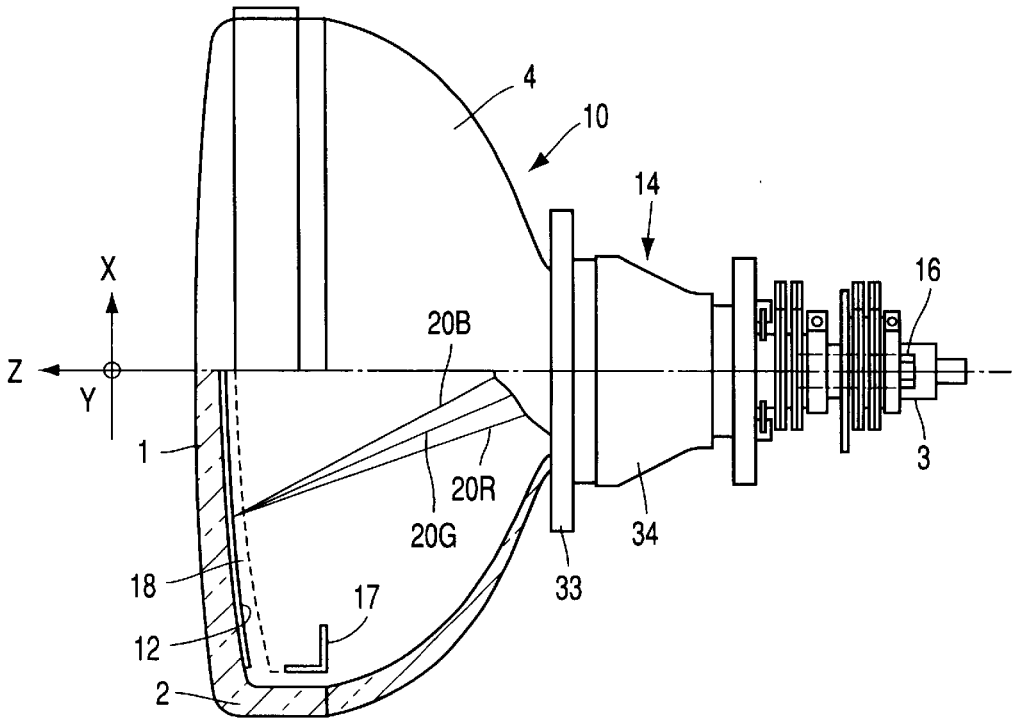
FIG. 1 is a partially cross-sectional plan view of a color cathode-ray tube apparatus according to an embodiment of the present invention.
Figure 2:
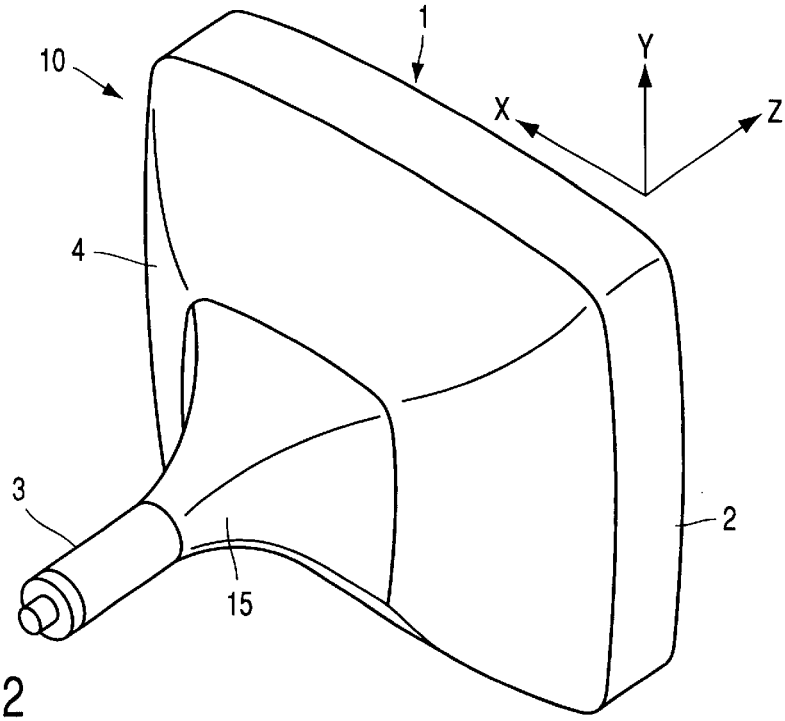
FIG. 2 is a perspective view schematically showing the rear-side structure of a vacuum envelope of the color cathode-ray tube apparatus shown in FIG. 1.

As is shown in FIGS. 1 and 2, a color cathode-ray tube apparatus has a vacuum envelope 10. The vacuum envelope 10 comprises a substantially rectangular panel 1 with a peripheral skirt portion 2, a funnel 4 provided continuous with the skirt portion 2, and a cylindrical neck 3 provided continuous with a small-diameter end portion of the funnel 4. The panel 1 has a substantially flat outer surface. The panel 1 has a phosphor screen 12 comprises a plurality of phosphor layers emitting red, green and blue light and light-shield layers, which are disposed on an inner surface of the panel 1. A yoke mount section 15 for mounting of a deflection yoke 14 is formed on an outer peripheral portion of the vacuum envelope 10, which extends between the neck 3 and funnel 4.

An in-line electron gun assembly 16 is disposed within the neck 3. The in-line electron gun assembly 16 emits three electron beams 20R, 20G and 20B toward the phosphor layers of phosphor screen 12, these beams being arranged in line in a horizontal-axis direction extending in a single horizontal plane. The deflection yoke 14 produces non-uniform deflection magnetic fields that deflect the three electron beams 20R, 20G and 20B, which have been emitted from the electron gun assembly 16, in a horizontal-axis direction and a vertical-axis direction.

A shadow mask 18 having a color selection function is disposed inside the panel 1 between the electron gun assembly 16 and the phosphor screen 12. The shadow mask 18 is supported on the frame 17. The shadow mask 18 shapes the three electron beams 20R, 20G and 20B emitted from the electron gun assembly 16, and effects color selection such that the electron beams may strike the phosphor layers of specified colors.

The vacuum envelope 10 has a tube axis (center axis) Z coinciding with the axis of the neck 3 and extending through the center of the phosphor screen 12; a horizontal axis (major axis) X crossing at right angles with the tube axis Z; and a vertical axis (minor axis) Y crossing at right angles with the tube axis Z and horizontal axis X.

In the color cathode-ray tube apparatus with this structure, the three electron beams 20R, 20G and 20B emitted from the electron gun assembly 16 are deflected in the horizontal-axis direction and vertical-axis direction by the non-uniform deflection magnetic fields produced from the deflection yoke 14, and these beams are scanned over the phosphor screen 12 through the shadow mask 18 in the horizontal-axis direction and vertical-axis direction. Thus, a color image is displayed.

Figure 3A:
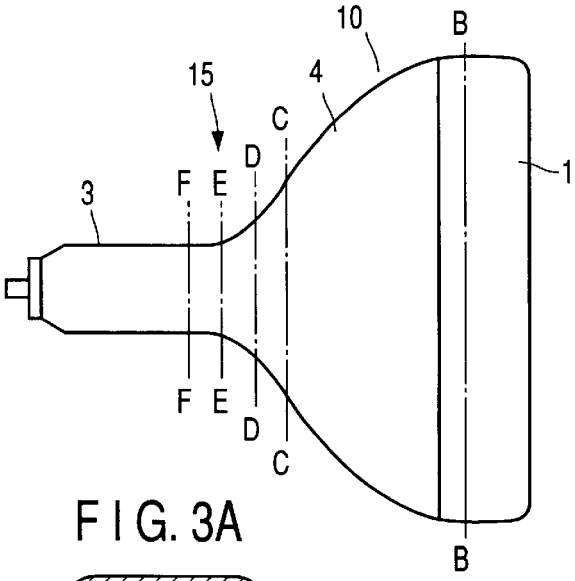
FIG. 3A is a side view of the vacuum envelope shown in FIG. 2.
Figure 3B:
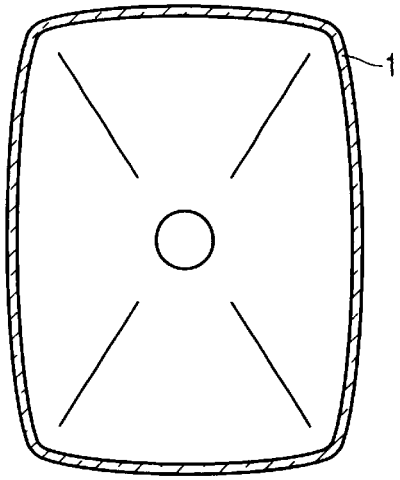
FIG. 3B is a cross-sectional view taken along line B—B in FIG. 3A.
Figure 3C:
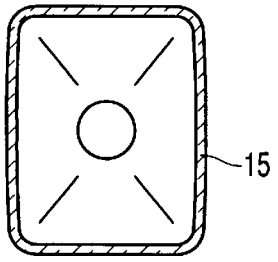
FIG. 3C is a cross-sectional view taken along line C—C in FIG. 3A.
Figure 3D:
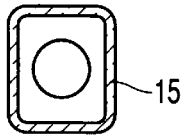
FIG. 3D is a cross-sectional view taken along line D—D in FIG. 3A.
Figure 3E:
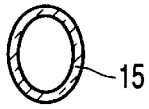
FIG. 3E is a cross-sectional view taken along line E—E in FIG. 3A.
Figure 3F:
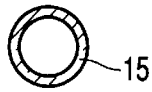
FIG. 3F is a cross-sectional view taken along line F—F in FIG. 3A.
Figure 4:
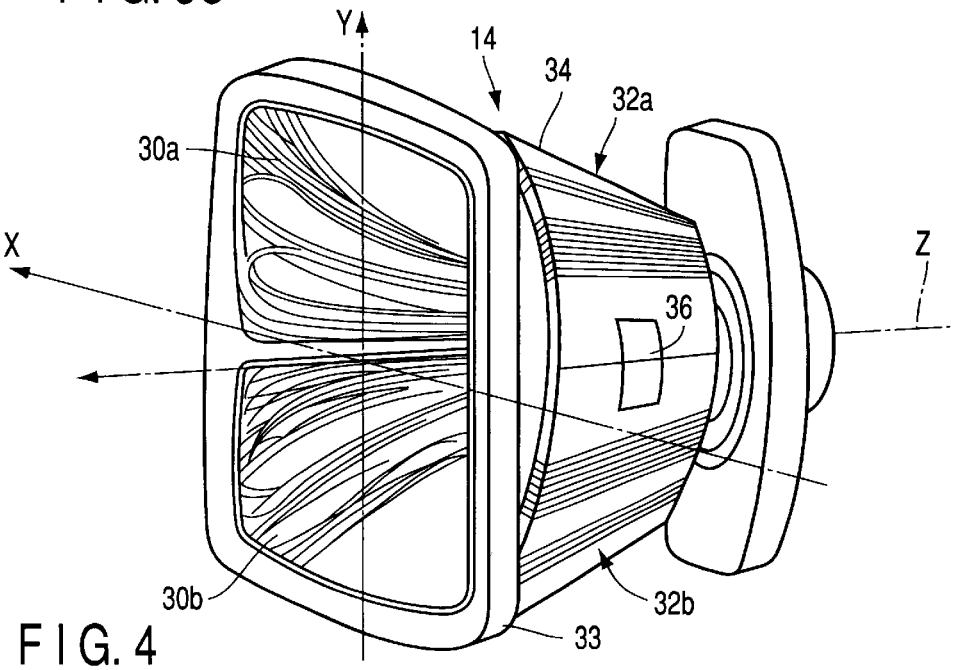
FIG. 4 is a perspective view schematically showing the structure of a deflection yoke applied to the color cathode-ray tube apparatus shown in FIG. 1.

As is shown in FIGS. 2 and 3B, the panel 1 of vacuum envelope 10 is formed in a substantially rectangular shape. In addition, as shown in FIG. 2 and FIGS. 3A to 3F, the yoke mount section of vacuum envelope 10 is formed to have such a shape as to gradually vary from a circular shape to a substantially rectangular shape from the neck 3 side toward the panel 1 (FIG. 3F→FIG. 3E→FIG. 3D→FIG. 3C). In this manner, the yoke mount section 15 is formed in a substantially truncated-pyramidal shape, and hence the dimensions of the deflection yoke 14 in the horizontal-axis direction X and vertical-axis direction Y can be decreased. It is therefore possible to place horizontal deflection coils 30*a* and 30*b* of deflection yoke 14 at a position close to the electron beams, thereby efficiently deflecting the electron beams and reducing electric power for deflection.

On the other hand, as shown in FIGS. 1 and 4 through 6, the deflection yoke 14 comprises a pair of horizontal deflection coils 30*a* and 30*b*, a pair of vertical deflection coils 32*a* and 32*b*, a separator 33, and a magnetic core 34.

The separator 33 is formed of a synthetic resin, etc. The separator 33 is formed in a substantially truncated-pyramidal shape corresponding to the shape of the outer surface of the yoke mount section 15. Specifically, the separator 33 has a large-diameter portion 33L on one end side (panel side) thereof along the tube axis Z, and a small-diameter portion 33S on the other end side (neck side) along the tube axis Z.

The magnetic core 34 has a substantially truncated-conical shape. Specifically, the magnetic core 34 has a large-diameter portion 34L at one end side along the tube axis Z, and a small-diameter portion 34S at the other end side along the tube axis Z. The magnetic core 34 is dividable into two parts along an X-Z plane including the tube axis Z, and these two parts are firmly coupled by means of fixing pieces 36. The magnetic core 34 is disposed coaxial with the tube axis Z so as to surround the outer periphery of the separator 33.

The horizontal deflection coils 30*a* and 30*b* produce, for example, a pincushion-shaped horizontal deflection magnetic field for deflecting the electron beams in the horizontal-axis direction X. The paired horizontal deflection coils 30*a* and 30*b* are saddle-shaped coils. The horizontal deflection coils 30*a* and 30*b* are disposed along the inner surface of separator 33 so as to be symmetric with respect to the tube axis Z. In short, the horizontal deflection coils 30*a* and 30*b* are disposed symmetric with respect to the X-Z plane including the tube axis Z. The horizontal deflection coils 30*a* and 30*b* are thus combined to have a substantially truncated-pyramidal shape. The horizontal deflection coils 30*a* and 30*b* have a large-diameter portion 30L at one end side along the tube axis Z, and a small-diameter portion 30S at the other end side along the tube axis Z.

The vertical deflection coils 32*a* and 32*b* produce, for example, a barrel-shaped vertical deflection magnetic field for deflecting the electron beams in the vertical-axis direction Y. The paired vertical deflection coils 32*a* and 32*b* are toroidal coils. The vertical deflection coils 32*a* and 32*b* are formed by winding coil wire in a toroidal fashion around the magnetic core 34 mounted on the outer surface of the separator. The vertical deflection coils 32*a* and 32*b* are disposed symmetric with respect to the X-Z plane including the tube axis Z. The vertical deflection coils 32*a* and 32*b* have a large-diameter portion 32L at one end side along the tube axis Z and a small-diameter portion 32S at the other end side along the tube axis.

Figure 11:
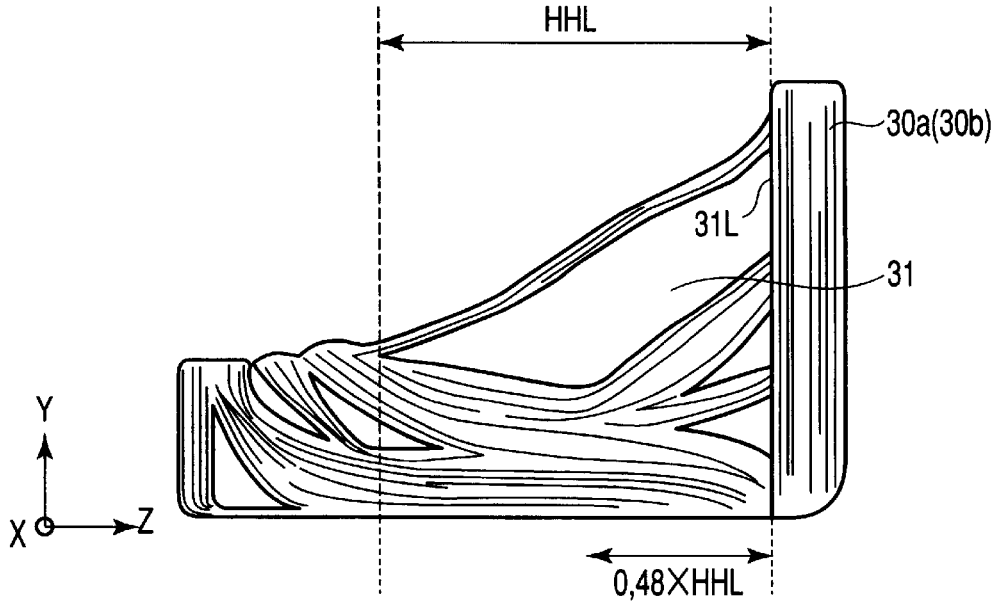
FIG. 11 is a side view schematically showing the structure of the horizontal deflection coil applied to the deflection yoke shown in FIG. 4.
Figure 12:
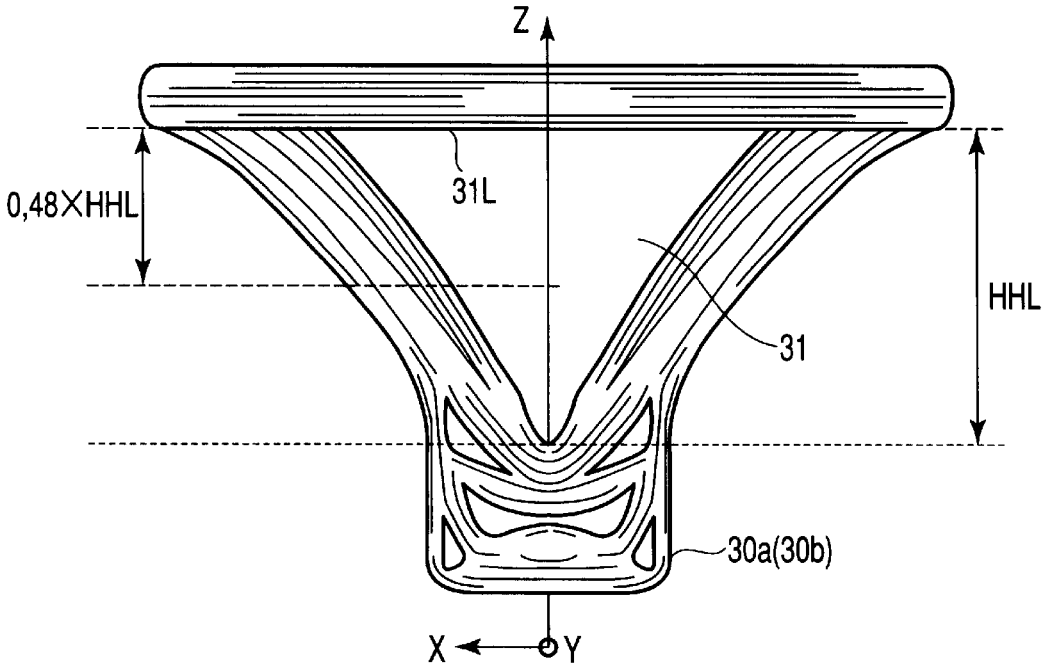
FIG. 12 is a plan view schematically showing the structure of the horizontal deflection coil applied to the deflection yoke shown in FIG. 4.

As is shown in FIGS. 11 and 12, at least one of both end portions of the paired horizontal deflection coils 30*a* and 30*b* in the tube-axis direction Z has a bendless shape. The bendless shape reduces power consumption, compared to a case where a bend portion is provided. Thus, the bendless shape is preferable in terms of reduction in electric power for deflection.

Figure 5A:
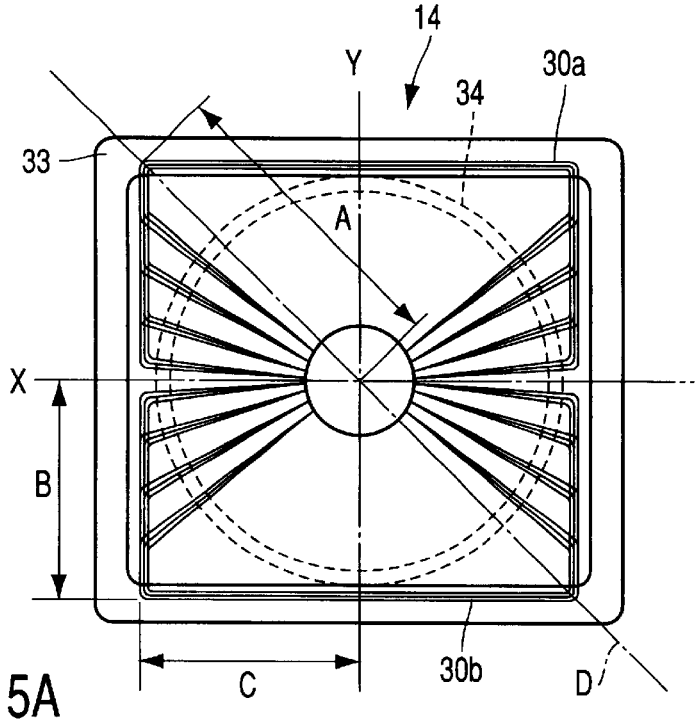
FIG. 5A is a front view of the deflection yoke shown in FIG. 4, as viewed from the panel side.
Figure 5B:
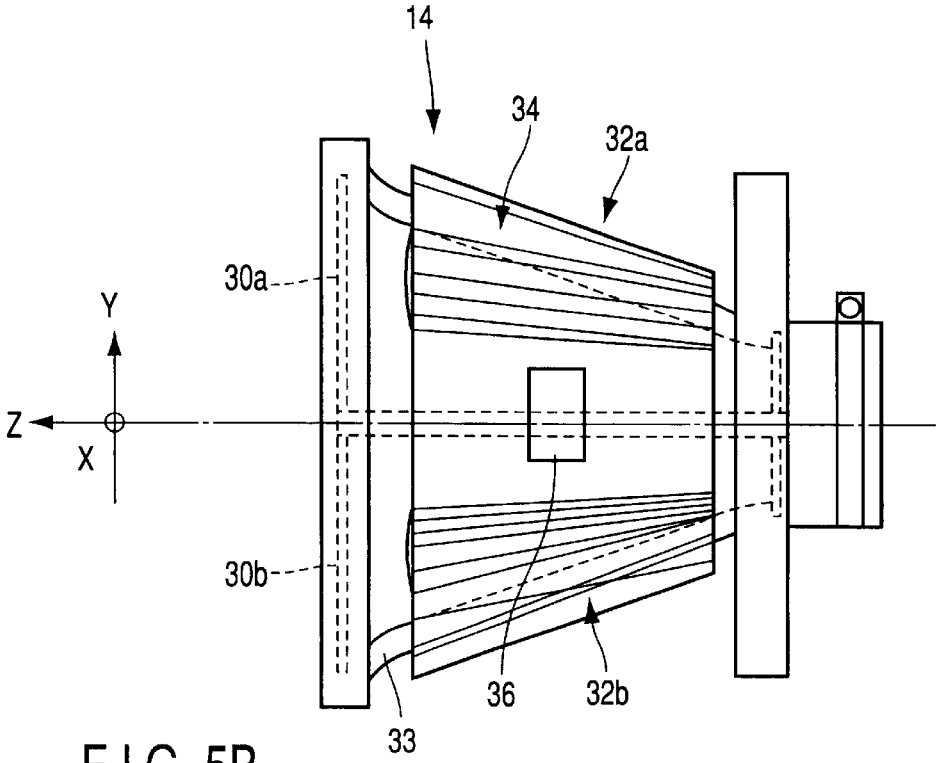
FIG. 5B is a side view of the deflection yoke shown in FIG. 4.
Figure 6:
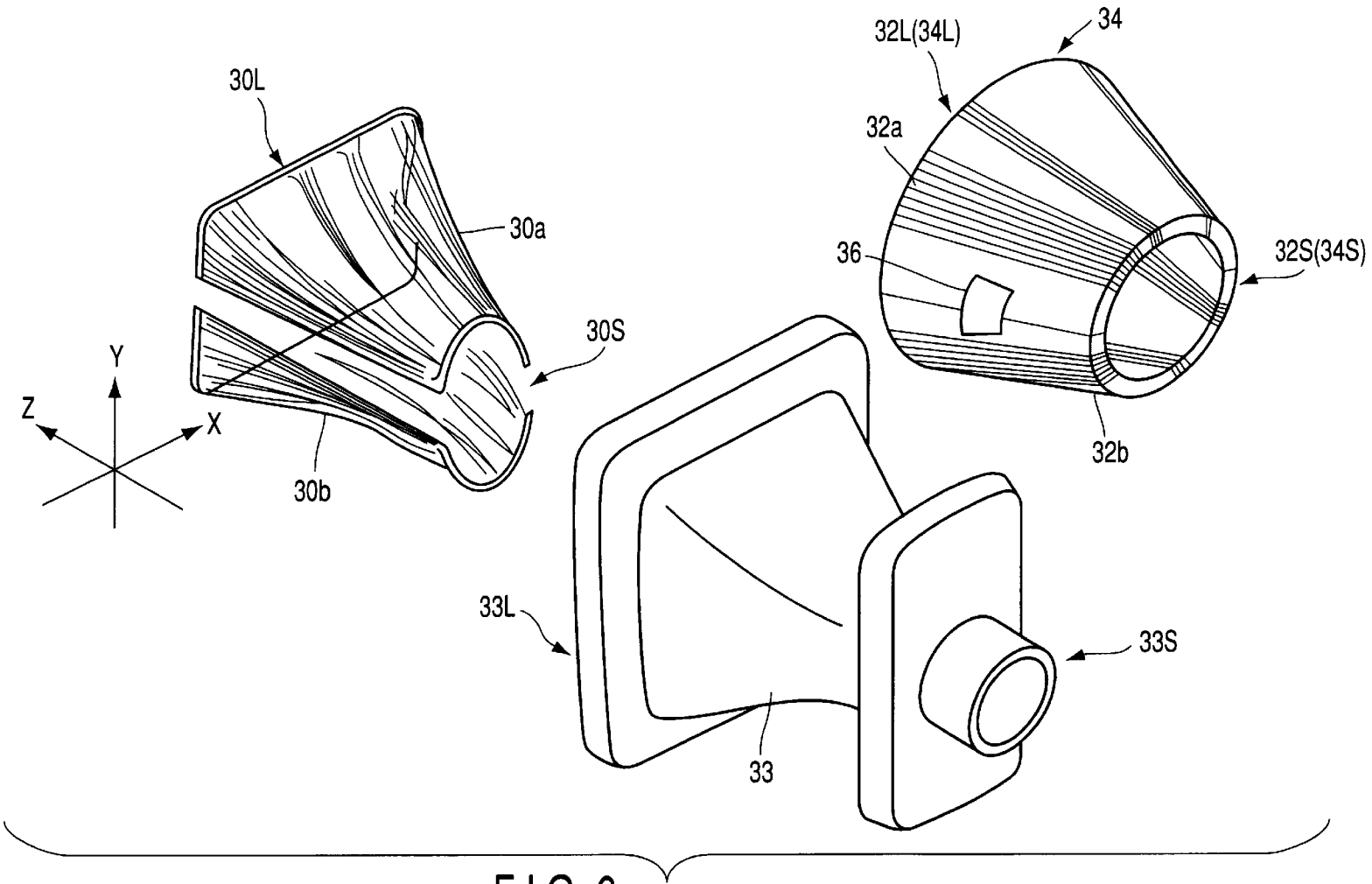
FIG. 6 is an exploded perspective view of the deflection yoke shown in FIG. 4.

In the deflection yoke 14, as shown in FIGS. 5A and 5B, the substantially truncated-conical magnetic core 34 is disposed closest to diagonal portions of the substantially truncated-pyramidal horizontal deflection coil 30*a*, 30*b*. Thus, the inside diameter and outside diameter of the distal end portion, or the large-diameter portion 34L, of the magnetic core 34 are determined by a diagonal diameter A in a diagonal-axis direction D of the large-diameter portion 30L of the substantially truncated-pyramidal horizontal deflection coils 30*a*, 30*b*.

Figure 7:
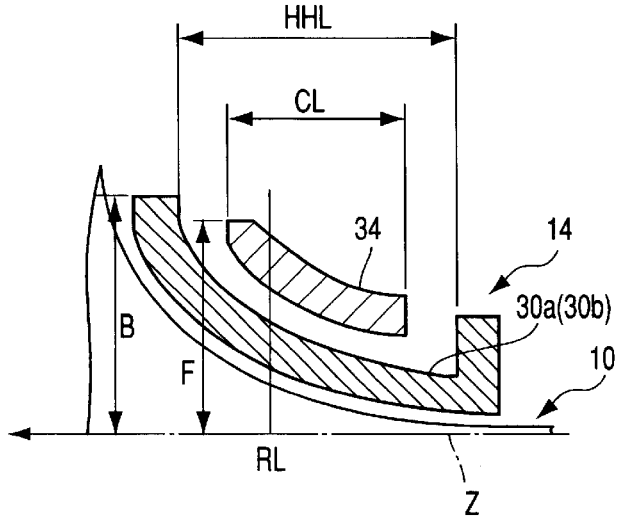
FIG. 7 shows the relationship between the horizontal deflection coil and the magnetic core.
Figure 8:
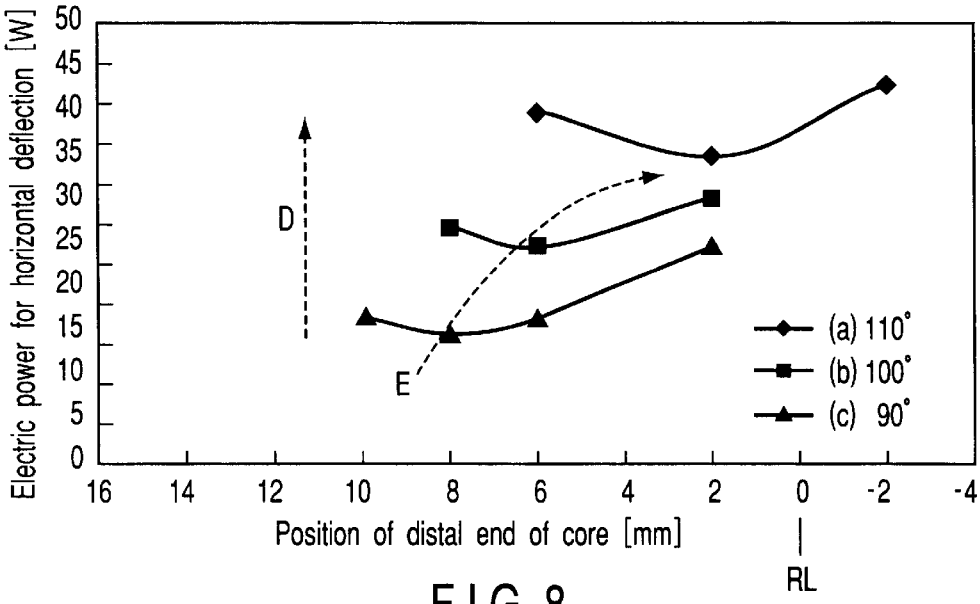
FIG. 8 is a graph showing the relationship between the position of the distal end of the magnetic core and the electric power for horizontal deflection.

Referring to FIG. 7, attention is paid to the positional relationship between the horizontal deflection coil 30*a* (30*b*) and magnetic core 34 in a cross section taken along the tube axis (center axis) Z of deflection yoke 14. In this case, it has been found that a relationship, as shown in FIG. 8, is present between the horizontal deflection electric power (W) and the distal end position of the magnetic core 34 (i.e. the position of the large-diameter portion 34L) (mm). In FIG. 8, the distal end position of the magnetic core 34 is expressed as a position in the tube-axis direction Z relative to a reference line RL that represents the electron beam deflection center in the deflection yoke 14. The panel 1 side is assumed to be a positive-value side, and the neck 3 side is assumed to be a negative-value side.

When the distal end position of magnetic core 34 is excessively shifted toward the neck 3, as shown in FIG. 8, the magnetic path length for an effective action upon the electron beams becomes shorter. It is understood that a power for deflection increases as a result. On the other hand, when the distal end position of magnetic core 34 is excessively shifted toward the panel 1, a vertical diameter B in the vertical-axis direction Y and a horizontal diameter C in the horizontal-axis direction X of the horizontal deflection coils 30*a* and 30*b* of deflection yoke 14, as shown in FIG. 5A, becomes longer. It is understood that consequently the deflection magnetic fields do not effectively act on the electron beams, resulting in an increase in power for deflection. In short, it is understood that there is an optimal position of the distal end of the magnetic core 34, which minimizes the electric power for deflection.

As is shown in FIG. 8, as the maximum deflection angle of electron beams increases from (c) 90° to (b) 100° to (a) 110° in the cathode-ray tube apparatus, the power for horizontal deflection increases (broken-line arrow D in the Figure). In addition, in a cathode-ray tube apparatus with a greater maximum deflection angle of electron beams, as compared to a cathode-ray tube apparatus with a smaller deflection angle, the vertical diameter B and horizontal diameter C of the horizontal deflection coil 30*a* (30*b*) on the large-diameter portion 34L side of magnetic core 34 increases in accordance with shifting of the distal end position of magnetic core 34 toward the panel. Consequently, the deflection fields act less effectively on the electron beams. It is thus understood that the distal end position of the magnetic core 34 shifts to the neck side when the power for horizontal deflection takes a minimum value.

Similarly, assume that the maximum deflection angle is same in the cathode-ray tube apparatus and substantially truncated-pyramidal horizontal deflection coils are substituted for conventional substantially truncated-conical horizontal deflection coils. In this case, even if the diagonal diameter A of the horizontal deflection coil is equal to that of the conventional coil, the vertical diameter B and horizontal diameter C can be made less than in the prior art. Therefore, the electric power for deflection can be minimized by setting the distal end position of the magnetic core 34 at the optimal position on the panel 1 side.

If the substantially truncated-pyramidal horizontal deflection coils 30*a* and 30*b* are merely used and the distal end position of the magnetic core 34 is set at the optimal position on the panel 1 side in order to reduce the electric power for deflection, the entire length CL in the tube-axis direction Z of the magnetic core 34 becomes longer. In this case, the manufacturing cost of the magnetic core 34 increases. Moreover, the panel-side diameter F of magnetic core 34 increases, and the distance from the horizontal deflection coil 30*a*, 30*b* increases. Consequently, the electric power for deflection is not decreased, and the electric power for vertical deflection increases due to the vertical deflection coils 32*a* and 32*b* wound around magnetic core 34 in the toroidal fashion. Therefore, the electric power for horizontal deflection and vertical deflection can be minimized by shortening that portion of magnetic core 34, which extends to the neck 3 side with no contribution to an increase/decrease of the electric power for horizontal deflection, that is, by setting the rear-end position on the neck 3 side at the optimal position on the panel 1 side. To the contrary, if the entire length CL of magnetic core 34 is made too short, the electric power for horizontal deflection and vertical deflection increases.

It is thus understood that the optimal relationship exits between the entire length HL in the tube-axis direction Z of the horizontal deflection coil 30*a*, 30*b* and the entire length CL in the tube-axis direction Z of the magnetic core 34.

On the other hand, if the center position in the tube-axis direction Z of the magnetic core 34 is excessively shifted toward the panel 1, the diameter F of the magnetic core 34 on the panel 1 side becomes large. Consequently, the distance from the horizontal deflection coil 30*a*, 30*b* increases and the deflection electric power increases. If the center position of the magnetic core 34 is excessively shifted toward the neck 3, electron beams deflected toward a corner portion on the phosphor screen 12 would impinge on the inner surface of the yoke mount section 15 and, as a result, an area on which no electron beams fall may occur near the corner of the phosphor screen.

Figure 9:
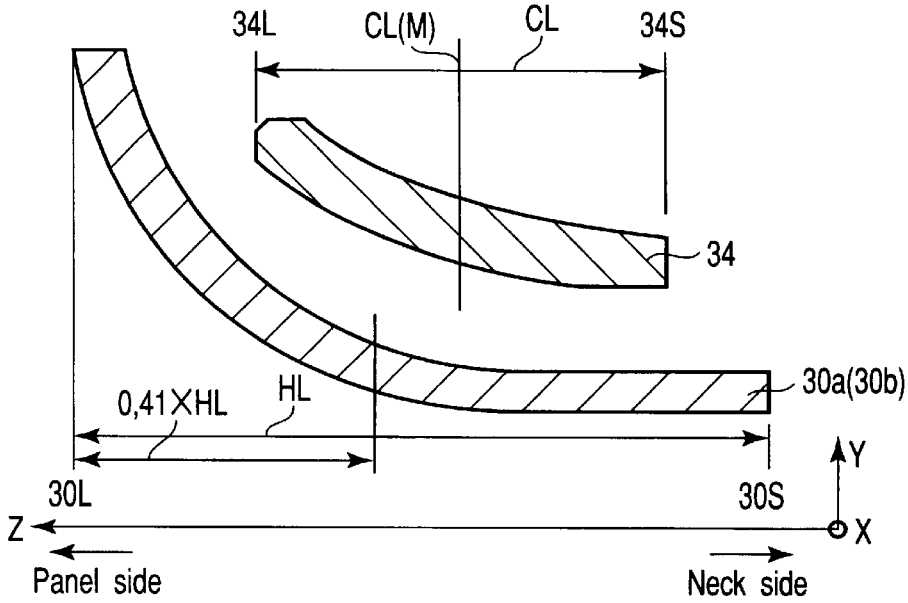
FIG. 9 is a view for explaining the positional relationship between the horizontal deflection coil and the magnetic core.

It is desirable, as described above, that the magnetic core 34 be disposed at the optimal position relative to the horizontal deflection coils 30*a* and 30*b*. Specifically, as shown in FIG. 9, a middle point CL(M) of the entire length CL in the tube-axis direction Z of the magnetic core 34 lies on the small-diameter portion 30S side of horizontal deflection coil 30*a*, 30*b* relative to a point lying at a distance of 0.41×HL in the tube-axis direction Z from the large-diameter portion 30L of horizontal deflection coil 30*a*, 30*b*. To be more specific, the middle point CL(M) of magnetic core 34 coincides with the middle point of the line segment CL between the large-diameter portion 34L and small-diameter portion 34S in the tube-axis direction Z.

Figure 10:
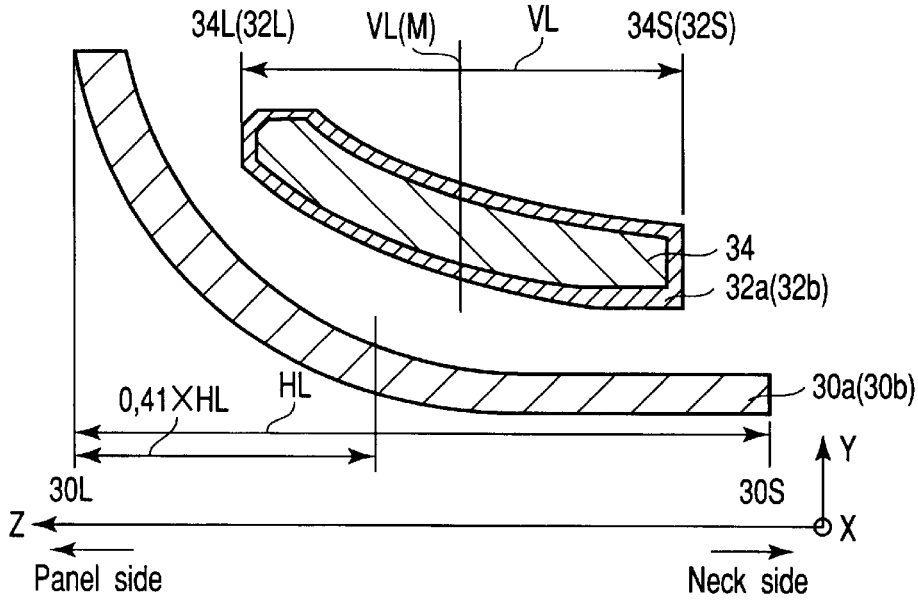
FIG. 10 is a view for explaining the positional relationship between the horizontal deflection coil and the vertical deflection coil.

The vertical deflection coils 32*a* and 32*b* are wound around the magnetic core 34. Hence, a middle point VL(M) of the entire length VL in the tube-axis direction Z of the vertical deflection coil 32*a*, 32*b* coincides substantially with the middle point CL(M) of the entire length CL of magnetic core 34 in the tube-axis direction Z. Specifically, as shown in FIG. 10, the middle point VL(M) of the entire length VL in the tube-axis direction Z of the vertical deflection coil 32*a*, 32*b* lies on the small-diameter portion 30S side of horizontal deflection coil 30*a*, 30*b* relative to a point lying at a distance of 0.41×HL in the tube-axis direction Z from the large-diameter portion 30L of horizontal deflection coil 30*a*, 30*b*. To be more specific, the middle point VL(M) of vertical deflection coil 32*a*, 32*b* coincides with the middle point of the line segment VL between the large-diameter portion 32L and small-diameter portion 32S in the tube-axis direction Z.

As described above, the substantially truncated-conical core 34 or the vertical deflection coil 32*a*, 32*b* wound around the magnetic core 34 is disposed in the above-described positional relationship relative to the substantially truncated-pyramidal horizontal deflection coil 30*a*, 30*b*. Thereby, the electron beams can efficiently be deflected, and the electric power for deflection can be reduced.

There is also an optimal relationship between the entire length HL in the tube-axis direction Z of the horizontal deflection coil 30*a*, 30*b* and the entire length CL (or VL) in the tube-axis direction Z of the magnetic core 34 (or vertical deflection coil 32*a*, 32*b*). Specifically, as shown in FIG. 9, the entire length HL of horizontal deflection coil 30*a*, 30*b* and the entire length CL of magnetic core 34 have the following relationship:

$$1.8 \leqq HL/CL \leqq 2.4.$$

Similarly, as shown in FIG. 10, the entire length HL of horizontal deflection coil 30*a*, 30*b* and the entire length VL of vertical deflection coil 32*a*, 32*b* have the following relationship:

$$1.8 \leqq HL/VL \leqq 2.4.$$

The deflection electric power can be reduced by setting the length of the magnetic core 34 or vertical deflection coil 32*a*, 32*b* relative to the horizontal deflection coil 30*a*, 30*b* according to the above relationships.

In this deflection yoke 14, as shown in FIGS. 11 and 12, the horizontal deflection coil 30*a*, 30*b* is formed of wound coil wire. In addition, the horizontal deflection coil 30*a*, 30*b* has an opening portion 31 defined by the coil wire. It is preferable that the magnetic core 34 be disposed at an optimal position relative to the opening portion 31 of the horizontal deflection coil. Specifically, assuming that the entire length in the tube-axis direction Z of the opening portion 31 of the horizontal deflection coil, i.e. the inside diameter of the coil, is HHL, the middle point CL(M) of magnetic core 34 lies on the small-diameter portion side of the horizontal deflection coil relative to a point lying at a distance of 0.48×HHL in the tube-axis direction Z from an end portion 31L of the opening portion 31 on the large-diameter portion side of the horizontal deflection coil.

Similarly, the middle point VL(M) of vertical deflection coil 32*a*, 32*b* lies on the small-diameter portion side of the horizontal deflection coil relative to a point lying at a distance of 0.48×HHL in the tube-axis direction Z from the end portion 31L of the opening portion 31 on the large-diameter portion side of the horizontal deflection coil.

By virtue of this positional relationship, the electron beams can efficiently be deflected, and the deflection electric power can be reduced.

There is also an optimal relationship between the inside diameter HHL of the horizontal deflection coil, which corresponds to the entire length of the opening portion 31 in the horizontal deflection coil, and the entire length CL (or VL) in the tube-axis direction Z of the magnetic core 34 (or vertical deflection coil 32*a*, 32*b*). To be specific, the entire length HHL of opening portion 31 and the entire length CL of magnetic core 34 have the relationship:

$$1.2 \leqq HHL/CL \leqq 1.8.$$

Similarly, the entire length HLL of the opening portion 31 and the entire length VL of vertical deflection coil 32*a*, 32*b* have the following relationship:

$$1.2 \leqq HHL/VL \leqq 1.8.$$

The deflection electric power can be reduced by setting the length of the magnetic core 34 or vertical deflection coil 32*a*, 32*b* relative to the opening portion 31 of the horizontal deflection coil according to the above relationships.

In these years, in accordance with the modern trend toward flattening of the outer surface shape of the panel 1, the inner surface shape of the panel 1 has also become flattened more and more. To meet the trend, if design is made to correct a pincushion type distortion at upper and lower areas of the screen and to make it substantially linear at the peripheral areas, the pincushion type distortion near an intermediate area in the vertical-axis direction Y may remain in some cases.

To solve this problem, it is necessary to set the relationship between the horizontal deflection coil 30*a*, 30*b*, and the vertical deflection coil 32*a*, 32*b* or magnetic core 34, as described above.

The deflection distortion is greatly affected by magnetic fields on the large-diameter opening portion side of deflection yoke 14, that is, on the phosphor screen side. Besides, a vertical pincushion type distortion is affected, in particular, by a horizontal deflection magnetic field.

Figure 13:
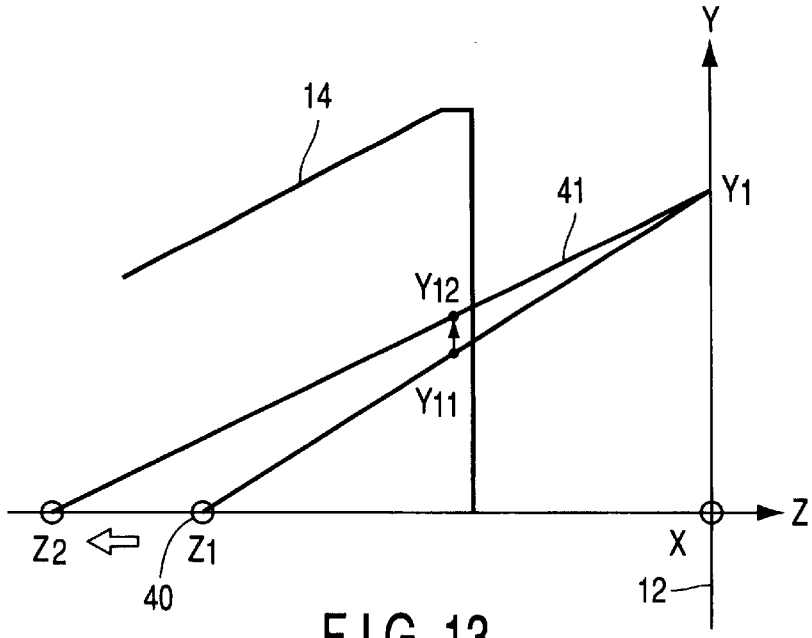
FIG. 13 shows the relationship between the shift of the center of vertical deflection and the trajectory of the electron beam in an intermediate region in the vertical-axis direction.

FIG. 13 illustrates a case where an electron beam is deflected toward an intermediate area Y1 in the vertical axis Y on the phosphor screen 12. In this case, if a virtual deflection center 40 of the vertical deflection coil 32*a*, 32*b* shifts from a position Z1 on the phosphor screen 12 side to a position Z2 on the neck 3 side, an electron beam trajectory 41 moves from a position Y11 to a position Y12 in the vertical-axis direction Y in the vicinity of the end portion on the phosphor screen 12 side. At this time, even where the horizontal deflection magnetic field is applied, the trajectory 41 moves from the position Y11 to position Y12 in a cross section parallel to the vertical axis Y.

Figure 14:
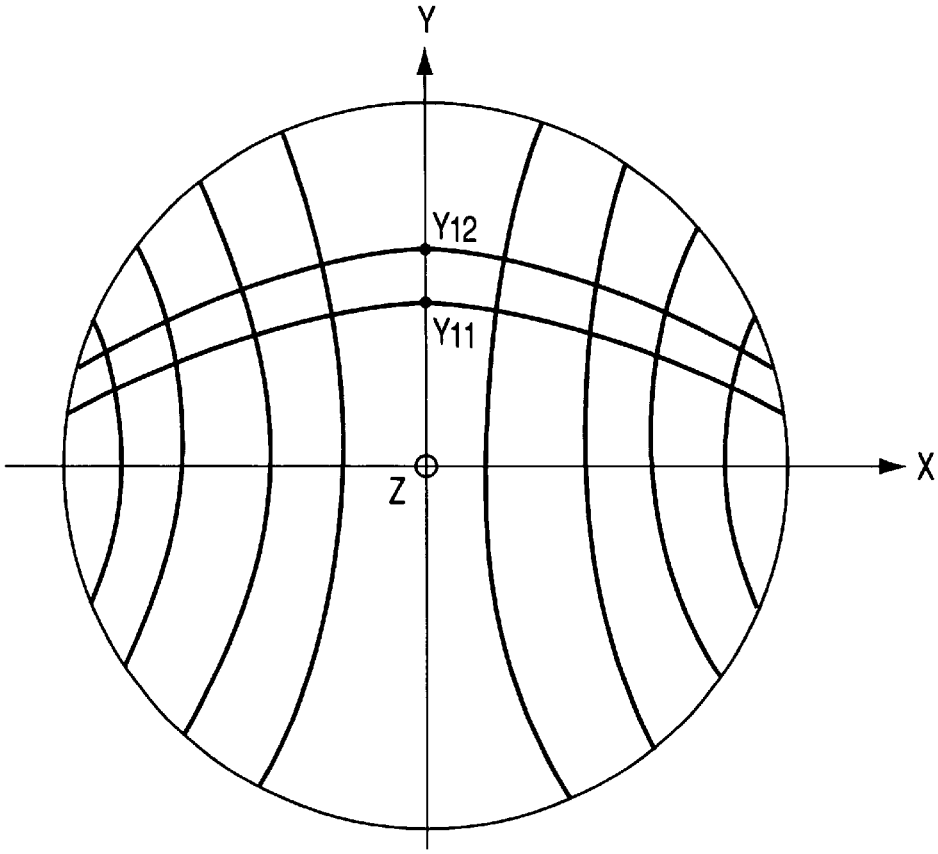
FIG. 14 shows the relationship between the horizontal deflection magnetic field and the vertical pincushion distortion.

The vertical pincushion type distortion is principally affected by the horizontal deflection magnetic field in the vicinity of the end portion on the phosphor screen 12 side of the deflection yoke 14. Thus, a distortion occurs in a direction perpendicular to the pincushion-shaped horizontal deflection magnetic field. Specifically, when an electron beam is deflected from the position Y11 and another electron beam is deflected from the position Y12 in the horizontal-axis direction X, as shown in FIG. 14, the electron beam deflected from the position Y12 has a greater tendency to have a barrel-type due to the pincushion-shaped deflection magnetic field, than the electron beam deflected from the position Y11.

Hence, the vertical pincushion type distortion can be improved. Based on the same principle, the vertical pincushion type distortion on peripheral areas has a greater tendency to become a barrel-type one. However, such distortion can be made substantially linear by optimizing the design of magnetic fields. Therefore, a good display quality can be obtained on the entire screen.

Besides, in the semi-toroidal deflection yoke 14, the horizontal deflection coil 30*a*, 30*b* has a substantially truncated-pyramidal saddle shape, the magnetic core 34 has a substantially truncated-conical shape, and the vertical deflection coil 32*a*, 32*b* is wound around the magnetic core 34 in a toroidal fashion. In this deflection yoke 14, the distance between the horizontal deflection coil 30*a*, 30*b* and the magnetic core 34 needs to be small on the neck 3 side and large on the phosphor screen 12 side. As a result, the deflection center of the horizontal deflection coil 30*a*, 30*b* shifts toward the neck 3, and the above-mentioned vertical pincushion type distortion occurs.

Accordingly, if the positional relationship between the horizontal deflection coil 30*a*, 30*b* and the vertical deflection coil 32*a*, 32*b* or magnetic core 34 is set as described above, the vertical pincushion type distortion can be improved even in the semi-toroidal deflection yoke 14. Therefore, the quality of display image on the screen can be enhanced.

The electric power for horizontal deflection occupies a high ratio in the power consumption of the deflection yoke 14. To cope with this problem, the horizontal deflection coil 30*a*, 30*b* is formed in the substantially truncated-pyramidal shape, and the horizontal diameter and vertical diameter thereof are reduced. Thereby, the horizontal deflection coils 30*a*, 30*b* can be made closer to the electron beams. Since the beams can efficiently be deflected, the electric power for deflection can be reduced.

In another method for obtaining the same advantage, the entire length HL of the horizontal deflection coil 30*a*, 30*b* is increased and the region, where the horizontal magnetic field acts on the electron beams, is extended in the tube-axis direction Z. In this method, however, the center of deflection shifts toward the neck, and the electron beam may impinge upon the inner surface of the yoke mount section 15 of vacuum envelope 10 before it reaches the phosphor screen.

To avoid this problem, it is necessary to set, as described above, the relationship in position and entire length between the horizontal deflection coil 30*a*, 30*b*, and the vertical deflection coil 32*a*, 32*b* or magnetic core 34.

Assume that the above-described semi-toroidal deflection yoke 14 is designed to have the relationship, 1.8>HL/VL, or 1.8>HL/CL. In this case, as shown in FIG. 15, effective deflection sensitivity fails to be obtained and the electric power for deflection is hardly reduced.

Assume, on the other hand, that the above-described semi-toroidal deflection yoke 14 is designed to have the relationship, HL/VL>2.4, or HL/CL>2.4. In this case, the entire length HL of the horizontal deflection coil 30*a*, 30*b* is too great and the deflection center shifts toward the neck. Consequently, as shown in FIG. 15, an area with no light emission may possibly occur in the vicinity of the corner of the screen. As a result, the quality of the display image displayed on the screen may deteriorate and the functions of the cathode-ray tube cannot fully be exhibited.

In order to reduce the electric power for deflection and fully exhibit the functions of the cathode-ray tube, it is thus necessary to meet the above-described condition, 1.8≦HL/VL≦2.4, or 1.8≦HL/CL≦2.4.

When the above-described semi-toroidal deflection yoke 14 is designed to have the relationship, 1.2>HHL/VL, or 1.2>HHL/CL, effective deflection sensitivity cannot be obtained and the electric power for deflection is hardly reduced, as shown in FIG. 16.

Assume, on the other hand, that the above-described semi-toroidal deflection yoke 14 is designed to have the relationship, HHL/VL>1.8, or HHL/CL>1.8. In this case, the entire length HL of the horizontal deflection coil 30*a*, 30*b* is too great and the deflection center shifts toward the neck. Consequently, as shown in FIG. 16, an area with no light emission may possibly occur on the screen. As a result, the quality of the display image displayed on the screen may deteriorate and the functions of the cathode-ray tube cannot fully be exhibited.

In order to reduce the electric power for deflection and fully exhibit the functions of the cathode-ray tube, it is thus necessary to meet the above-described condition, 1.2≦HHL/VL≦1.8, or 1.2≦HHL/CL≦1.8.

The deflection electric power in the color cathode-ray tube apparatus that meets the above condition was measured. In measuring the deflection electric power, the semi-toroidal deflection yoke 14 with the above-described structure, wherein the toroidal vertical deflection coils wound around the substantially truncated-conical magnetic core and the substantially-pyramidal saddle-shaped horizontal deflection coils are combined, was applied to the color cathode-ray tube having a diagonal dimension of 66 cm and a maximum deflection angle of 104 degrees.

In this color cathode-ray tube, the deflection electric power was 28 W, in the case where the inside diameter HHL of the horizontal deflection coil 30*a*, 30*b* in the tube-axis direction Z was 60 mm, the length between the end portion of the opening portion 31 on the large-diameter portion 30L side of the horizontal deflection coil 30*a*, 30*b* and the center CL(M) of the magnetic core 34 in the tube-axis direction Z was 31.3 mm (=(0.52×HHL)>(0.48×HHL)), and the entire length CL of the magnetic core 34 in the tube-axis direction Z was 38.5 mm (HHL/CL=1.56).

According to the color cathode-ray tube apparatus with the above structure, the yoke mount section of the vacuum envelope has the substantially truncated-pyramidal shape and the horizontal deflection coil has the substantially truncated-pyramidal shape corresponding to the yoke mount section. Thus, the horizontal deflection coil, though it has a diagonal dimension equal to that of a substantially truncated-conical one, can have a less horizontal diameter and a less vertical diameter.

At this time, the magnetic core (or vertical deflection coil) is disposed in a predetermined positional relationship with the horizontal deflection coil. In addition, the length of the magnetic core (or vertical deflection coil) has a predetermined relationship with the horizontal deflection coil. Thereby, the horizontal deflection coil can be situated closer to the electron beams. As a result, the electron beams can be efficiently deflected, and the deflection electric power of the deflection yoke can optimally be reduced. Moreover, the pincushion type distortion in the vertical direction of the screen can be improved, and a high-quality display image can be obtained.

Besides, in this semitoroidal deflection yoke, compared to the deflection yoke using the substantially truncated-pyramidal magnetic core, the magnetic core can be manufactured easily and inexpensively with high precision. Therefore, the manufacturing cost of the deflection yoke can be reduced and a high performance can be realized.

Furthermore, with the use of the substantially truncated-conical magnetic core, the gap between the horizontal deflection coil and magnetic core in the vicinity of the vertical axis of the deflection yoke increases. Accordingly, heat produced from the horizontal deflection coil can easily be radiated. Even if the deflection frequency is increased, a temperature rise of the deflection yoke can fully be suppressed.

The present invention is not limited to the above embodiments, and various modifications can be made within the scope of the invention. For example, this invention is applicable not only to the color cathode-ray tube apparatus, but also to a monochromatic cathode-ray tube apparatus.

The present invention can provide a deflection yoke with reduced deflection electric power, manufacturing cost and heat emission amount, and with an enhanced quality of a display image on the screen, and a cathode-ray tube apparatus having this deflection yoke.

What is claimed is:

1. A deflection yoke comprising:

a pair of saddle-shaped horizontal deflection coils disposed to be symmetric with respect to a center axis and having a substantially truncated-pyramidal shape;

a magnetic core having a substantially truncated-conical shape and disposed coaxially with the center axis on an outer peripheral side of the horizontal deflection coils; and a pair of toroidal vertical deflection coils disposed to be symmetric with respect to the center axis, wherein a middle point of an entire length along the center axis from a large-diameter portion to a small-diameter portion of the magnetic core lies on a small-diameter portion side of the horizontal deflection coil relative to a point lying at a distance of 0.41×HL along the center axis from a large-diameter portion of the horizontal deflection coil, where HL is an entire length of the horizontal deflection coil along the center axis.

2. A deflection yoke according to claim 1, wherein $1.8 \leqq HL/CL \leqq 2.4$, where CL is the entire length of the magnetic core along the center axis.

3. A deflection yoke according to claim 1, wherein the horizontal deflection coils have an opening portion defined by wound coil wire, and the middle point of the entire length along the center axis from the large-diameter portion to the small-diameter portion of the magnetic core lies on the small-diameter portion side of the horizontal deflection coil relative to a point lying at a distance of 0.48×HHL along the center axis from an end portion of the opening portion on a large-diameter portion side of the horizontal deflection coil, where HHL is an entire length of the opening portion of the horizontal deflection coils along the center axis.

4. A deflection yoke according to claim 1, wherein the horizontal deflection coils have an opening portion defined by wound coil wire, and $$1.2 \leqq HHL/CL \leqq 1.8,$$

where CL is the entire length of the magnetic core along the center axis, and HHL is an entire length of the opening portion of the horizontal deflection coils along the center axis.

5. A deflection yoke according to claim 1, wherein the vertical deflection coils are wound around the magnetic core.

6. A deflection yoke according to claim 1, wherein at least one of both end portions of the horizontal deflection coil along the center axis is bendless.

7. A deflection yoke according to claim 1, wherein the yoke includes a substantially truncated-pyramidal separator, the pair of horizontal deflection coils are provided along an inner surface of the separator, and the magnetic core is disposed outside the separator.

8. A cathode-ray tube apparatus comprising:

a vacuum envelope having a panel with a phosphor screen disposed on an inside of the panel, a funnel formed continuous with the panel, and a cylindrical neck formed continuous with a small-diameter end portion of the funnel;

an electron gun assembly disposed within the neck and emitting electron beams toward the phosphor screen; and a deflection yoke mounted on an outside of the vacuum envelope and producing deflection magnetic fields for deflecting the electron beams emitted from the electron gun assembly in horizontal and vertical directions, wherein the deflection yoke comprises:

a pair of saddle-shaped horizontal deflection coils disposed to be symmetric with respect to a tube axis and having a substantially truncated-pyramidal shape;

a magnetic core having a substantially truncated-conical shape and disposed coaxially with the tube axis on an outer peripheral side of the horizontal deflection coils; and a pair of toroidal vertical deflection coils disposed to be symmetric with respect to the tube axis, wherein a middle point of an entire length along the tube axis from a large-diameter portion to a small-diameter portion of the magnetic core lies on a small-diameter portion side of the horizontal deflection coil relative to a point lying at a distance of 0.41×HL along the tube axis from a large-diameter portion of the horizontal deflection coil, where HL is an entire length of the horizontal deflection coil along the tube axis.

9. A deflection yoke comprising:

a pair of saddle-shaped horizontal deflection coils disposed to be symmetric with respect to a center axis and having a substantially truncated-pyramidal shape;

a magnetic core having a substantially truncated-conical shape and disposed coaxially with the center axis on an outer peripheral side of the horizontal deflection coils; and a pair of toroidal vertical deflection coils disposed to be symmetric with respect to the center axis, wherein a middle point of an entire length along the center axis from a large-diameter portion to a small-diameter portion of the vertical deflection coil lies on a small-diameter portion side of the horizontal deflection coil relative to a point lying at a distance of 0.41×HL along the center axis from a large-diameter portion of the horizontal deflection coil, where HL is an entire length of the horizontal deflection coil along the center axis.

10. A deflection yoke according to claim 9, wherein $1.8 \leqq HL/VL \leqq 2.4$, where VL is the entire length of the vertical deflection coil along the center axis.

11. A deflection yoke according to claim 9, wherein the horizontal deflection coils have an opening portion defined by wound coil wire, and the middle point of the entire length along the center axis from the large-diameter portion to the small-diameter portion of the vertical deflection coil lies on the small-diameter portion side of the horizontal deflection coil relative to a point lying at a distance of 0.48×HHL along the center axis from an end portion of the opening portion on a large-diameter portion side of the horizontal deflection coil, where HHL is an entire length of the opening portion of the horizontal deflection coils along the center axis.

12. A deflection yoke according to claim 9, wherein the horizontal deflection coils have an opening portion defined by wound coil wire, and $$1.2 \leqq HHL/VL \leqq 1.8,$$

where VL is the entire length of the vertical deflection coil along the center axis, and HHL is an entire length of the opening portion of the horizontal deflection coils along the center axis.

* * * * *